United States Patent [19]

Prosser

[11] Patent Number: 4,956,542

[45] Date of Patent: Sep. 11, 1990

[54] MIRROR DEFOGGER

[76] Inventor: Robert Prosser, P.O. Box 4425, Carlsbad, Calif. 92008

[21] Appl. No.: 313,062

[22] Filed: Feb. 21, 1989

Related U.S. Application Data

[63] Continuation of Ser. No. 242,877, Sep. 12, 1988, abandoned.

[51] Int. Cl.[5] ..... H05B 3/84

[52] U.S. Cl. ..... 219/219

[58] Field of Search ..... 219/219, 345, 548, 549; 350/582, 588

[56] References Cited

U.S. PATENT DOCUMENTS

| | | | |
|---|---|---|---|
| 1,933,173 | 10/1933 | Hunt | 219/219 |
| 2,564,836 | 8/1951 | Elsenheimer | 219/219 |
| 3,052,787 | 9/1962 | Williams | 219/219 |
| 3,160,736 | 12/1964 | Catterson | 219/219 |
| 3,530,275 | 9/1970 | Rust | 219/219 |
| 3,806,702 | 4/1974 | Spencer | 219/345 |
| 3,839,620 | 10/1974 | Seibel | 219/219 |
| 3,881,788 | 6/1975 | Seibel | 219/219 |
| 3,934,111 | 1/1976 | Roselli | 219/219 |
| 4,631,391 | 12/1986 | Tiepke | 219/219 |
| 4,665,304 | 5/1987 | Spencer | 219/219 |

FOREIGN PATENT DOCUMENTS

| | | | |
|---|---|---|---|
| 2325015 | 12/1974 | Fed. Rep. of Germany | 219/219 |
| 1277368 | 10/1961 | France | 219/219 |
| 216594 | 12/1984 | German Democratic Rep. | 219/549 |
| 1545770 | 5/1979 | United Kingdom | 219/219 |
| 1568665 | 6/1980 | United Kingdom | 219/219 |

*Primary Examiner*—Teresa J. Walberg

*Attorney, Agent, or Firm*—Andsel Group, Inc.

[57] ABSTRACT

A mirror defogger assembly having a plurality of adhesively coated elements for covering a variety of mirror shapes. Mirror heating elements are activated by means of a humidistat signaling a control module when humidity reaches a preset level. Heating elements are capable of front or rear mounting on the mirror. Humidistat signal can be electronic pulse, ultra-sound transmission, infrared beam, or radio signal. Control module operates on alternating current and has the ability to respond to manual command. Heating elements are provided with an automatic shut off sensor to prevent overheating damage.

9 Claims, 1 Drawing Sheet

MIRROR DEFOGGER

This application is a continuation of application Ser. No. 242,877 filed on Sept. 12, 1988 now abandoned.

BACKGROUND OF THE INVENTION

1. Field of the Invention

Mirror surfaces installed in bath and shower rooms are subject to moisture condensation on the reflecting surface which blurs and distorts the reflected image on the mirror face. It is known that warming a mirror surface to a temperature of four degrees Fahrenheit or greater above the ambient air temperature will prevent the formation of moisture on the mirror surface.

2. Description of Related Art

A review of the prior art reveals many designs of heating elements that can be affixed to the rear surface of mirrors to provide the necessary temperature to prevent moisture condensation, or fogging.

An early U.S. Pat. No. 1,993,173, 1933, Hunt, describes the basic concept for applying heating elements to a mirror. A more recent solution to the problem is described by Spencer in U.S. Pat. No. 4,665,304 who claims the application of an electrical conductive laminate placed behind a conventional mirror glass to provide heat to the mirror. Other pertinent prior art includes: U.S. Pat. No. 3,160,736, Catterson; and U.S. Pat. No. 3,887,788, Seibel et al.

SUMMARY OF THE INVENTION

It is an objective of the present invention to provide an economical mirror defogger that can be easily applied to an existing installed mirror, contrasting to the many designs that must be incorporated into the mirror assembly at the factory.

A second objective of the present invention is to provide means of mounting or applying the invention to either the front or rear surface of a mirror.

Another objective of the present invention is to provide means of humidity detection, separately located from the mirror mounted heating element, where said detector automatically sends an electronic signal when room humidity level reaches a pre-determined point. Said detector signal is sent by means of electrical impulse, or by means of high-frequency ultra-sonics, or by means of an infrared signal or by means of a radio magnetic signal. Upon receipt of one of said signals by the control module, the heating element of the invention is activated, warming the mirror surface.

Another objective of the present invention is to utilize state-of-the-art heating elements, actuated by a control module where said module operates from 120 volt standard house current and has the capability to convert alternating current to direct current power. Heating elements are composed of a plurality of serpentine coils, or other state of the art heating element design, in order to cover any possibility of the various geometric shapes of mirrors.

Another objective of the present invention is to incorporate a thermistor control within the heating element to prevent overheating damage to the element and to regulate electrical flow to the heating element.

Another objective of the present invention is to provide an adhesive coating as means of bonding heating element to the mirror surface. Said adhesive coating is protected by peel-off plastic material.

Still another objective of the present invention is to provide temperature sensitive, time sensitive and humidity sensitive control switching through the programmable control module. Said module does not have to be mounted adjacent to the mirror heating element. Manual operation is possible by means of a manually operated switch for times when heating the mirror surface is desired and humidity conditions will not automatically activate the sensor mechanism. Located within the control module of the present invention is an electric transformer and transformer. Unit is therefore capable of receiving 120 volt house current and transforming direct current power to the heating elements and sensors.

A final objective of the present invention is to provide an automatic timer to turn off the heater after the mirror has been heated for a predetermined length of time.

DETAILED DESCRIPTION OF THE PREFERRED EMBODIMENT

Figure 1:
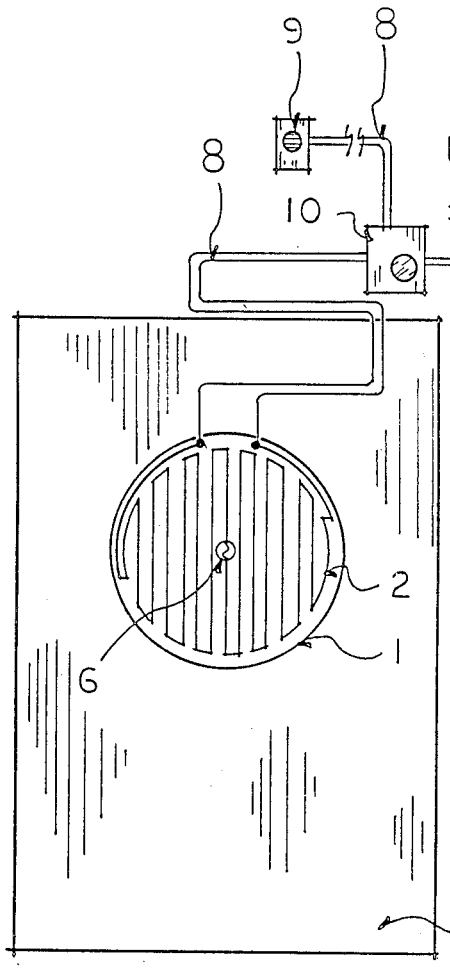
FIG. 1 is a view of a mirror with the heating element attached thereto and shows the heating element connectably attached by electrical wires to a humidity sensor and control module.

Referring to FIG. 1, the mirror surface 5, has sheet 3, attached directly to the surface. Said adhesive sheeting bonds heating element 2 with centrally located thermistor 6, to the mirror surface.

Located separately from the mirror is humidistat 9 and control module 10 that has a transformer and a converter. Mirror heating elements are connectably attached to the control module and humidistat by means of electrical wiring 8. Power for the system comes from plug 11 and wire cable 12 which conducts 120 volt alternating current to the transformer in control module 10.

Figure 2:
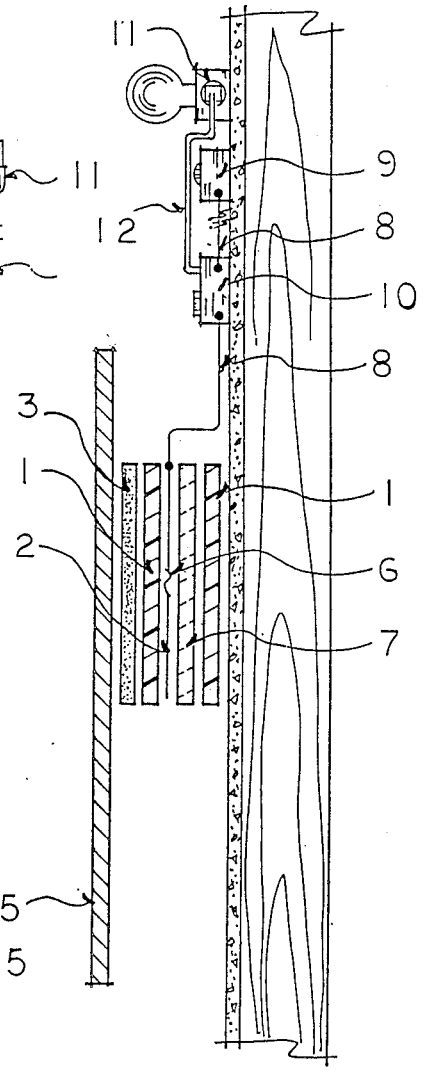
FIG. 2 is a sectional view showing the sequential arrangement of heating materials mounted on a mirror with the control module and humidistat mounted above.

In FIG. 2 an expanded sectional view of the invention is shown. Mirror surface 5 is first covered with adhesive coating 3 where said adhesive coating bonds a sheet of electrically insulating material 1 and heating element 2 with centrally located thermistor 6 to the mirror surface. Behind the heating element a sheet of reflective material 7 is held in place by the final sheet of electrical insulating material 1.

Located separately and above the mirror are the control module 10 and the humidistat 9. Connecting wiring 8 is shown between the components. Humidistat 9 is capable of issuing a signal in the form of an electronic pulse over a wire, or an ultrasonic frequency through the air, or an infrared signal pulse or a radio magnetic signal. Said signal, when received by the control module/transformer 10, will activate the heating element 2.

Power plug 11 is connected to a combination light and power outlet with cable 12 conducting 120 volt power to the transformer of the control module 10.

Figure 3:
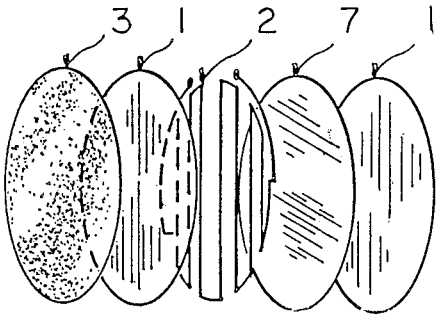
FIG. 3 illustrates in exploded view the sequential arrangement the heating element when affixed to a mirror.

FIG. 3 is an expanded view of illustrating sequential layering of the components which attach to the mirror surface. Attachable to either front or rear surface of the mirror the sequence would be adhesive 3, insulator 1, heating element grid 2, reflective material 7 and insulation sheeting 1.

The drawings as shown and thusly described represent the preferred embodiment of the invention. It would be obvious to one skilled in the art that various changes and modifications, simple or complex, could be made to the preferred embodiment which would alter the appearance of the invention but not the scope, spirit and intention of the invention. It is the intention of the inventor to preclude the occurrence of such emulations in design, scope or spirit through the following claims.

I claim:

1. An improved electric heating source fastened to a surface of a mirror for supplying heat to reduce the formation of moisture on the mirror surface wherein the improvement comprises:

a. a heating element adhesively mounted to the surface of the mirror where the heating element is capable of conforming to any given geometrical shape;

b. a thermist or centrally mounted within and connected to the heating element to provide a means of electronic temperature control to protect from overheating of the heating elements;

c. an adhesive coating on both sides of the heating element and protected by a removable covering sheet of material;

d. an electronic control module mounted in the proximity of the mirror and intimately connected thereto;

e. a manually operable electrical activation switch to activate the heating element;

f. an automatically timed electric de-activation function switch which manages the control module;

g. a humidistat that is remotely situated from the heating element and which sends a signal that is humidity activated through airwaves and a means for receiving the signal from the humidistat to activate the heating element;

h. the humidistat being operable with DC and AC voltage;

i. a converter to selectively convert alternating current from an AC power source to direct current; and j. a system circuit electrically connecting the manually operable activation switch, the humidistat, the automatically timed electric de-activation function switch, the electronic control module, the converter, the heating element, the thermistor and the AC power source.

2. An improved electric heating source as described in claim 1 wherein the humidistat further comprises an electronic impulse signal means for sending an electronic impulse signal to the control module when a predetermined humidity range is sensed.

3. An improved electric heating source as described in claim 1 further comprising a temperature limiting sensor circuit in the system circuit to open the system circuit when excessive current is detected and to cease power flow to the heating element whenever the temperature of the heating element reaches a preset limit.

4. An improved electric heating source as described in claim 1 wherein the humidistat sends a signal to the means for receiving a signal that is an electrical impulse by means of a wire connected to the means for receiving the signal.

5. An improved electrical heating source as described in claim 1 wherein the signal sent by the humidistat is an infrared signal.

6. An improved electrical heating source as described in claim 1 wherein the signal sent by the humidistat is an ultrasonic frequency signal.

7. An improved electrical heating source as described in claim 1 wherein the signal sent by the humidistat is a radio magnetic signal.

8. An improved electrical heating source as described in claim 1 wherein the humidistat is operable with DC voltage in a range of 1.5 to 12 volts and with AC voltage.

9. An improved electric heating source fastened to a surface of a mirror for supplying heat to reduce the formation of moisture on the mirror surface wherein the improvement comprises:

a. a heating element adhesively mounted to the surface of the mirror and the heating element being capable of conforming to any given geometrical shape;

b. a thermistor centrally mounted within the heating element to provide a means of electronic temperature control to protect from overheating of the heating element;

c. an adhesive coating on both sides of the heating element and protected by a removable covering sheet of material;

d. an electronic control module mounted in the proximity of the mirror and intimately connected thereto;

e. a manually operable electrical activation switch to activate the heating element;

f. an automatically timed electric de-activation function switch which manages to control module;

g. a humidistat that is remotely situated from the heating element and that has an electronic impulse signal means for sending a signal that is activated when a predetermined humidity range is sensed and that sends the signal through airwaves to a control module with a means for receiving the signal and activating the heating element;

h. the humidistat being operable with DC and AC voltage;

i. a converter to selectively convert alternating current from an AC power source to direct current;

j. a system circuit electrically connecting the manually operable activation switch, the humidistat, the automatically timed electric de-activation function switch, the electronic control module, the converter, the heating element and the AC power source; and k. a temperature limiting sensor circuit in the system circuit to open the system circuit when excessive current is detected and to cease power flow to the heating element whenever the temperature of the heating element reaches a preset limit.

* * * * *